United States Patent [19]

Amin

[11] 4,375,994

[45] Mar. 8, 1983

[54] ALTERNATE METHOD FOR INDUCING SUPERPLASTIC PROPERTIES IN NONSUPERPLASTIC METAL AND ALLOY POWDERS

[75] Inventor: Kamal E. Amin, Columbia, Md.

[73] Assignee: The Bendix Corporation, Southfield, Mich.

[21] Appl. No.: 361,280

[22] Filed: Mar. 24, 1982

[51] Int. Cl.[3] ..... C22F 1/00

[52] U.S. Cl. ..... 148/11.5 P

[58] Field of Search ..... 148/11.5 P, 11.5 R, 148/11.5 C

[56] References Cited

U.S. PATENT DOCUMENTS

| | | | |
|---|---|---|---|
| 3,591,916 | 7/1971 | Arthur | 148/11.5 R |
| 3,649,375 | 3/1972 | Venkatesan | 148/11.5 R |
| 3,862,863 | 1/1975 | Gervais et al. | 148/11.5 R |
| 3,997,369 | 12/1976 | Grimes et al. | 148/11.5 C |

*Primary Examiner*—W. Stallard

*Attorney, Agent, or Firm*—James R. Ignatowski; Russel C. Wells

[57] ABSTRACT

The invention is a method for inducing superplastic properties in nonsuperplastic metal and metal alloy powders by adding to such powders a small quantity of pure metal capable of alloying with the nonsuperplastic material to form a eutectic having superplastic properties. The powder is initially heated to the melting temperature of the desired eutectic to form the superplastic eutectic at the grain boundaries of the nonsuperplastic material. After forming, the powder is heat soaked to further dissolve the pure metal, destroying the formed eutectic and restoring the natural grain boundaries of the nonsuperplastic material.

18 Claims, 1 Drawing Figure

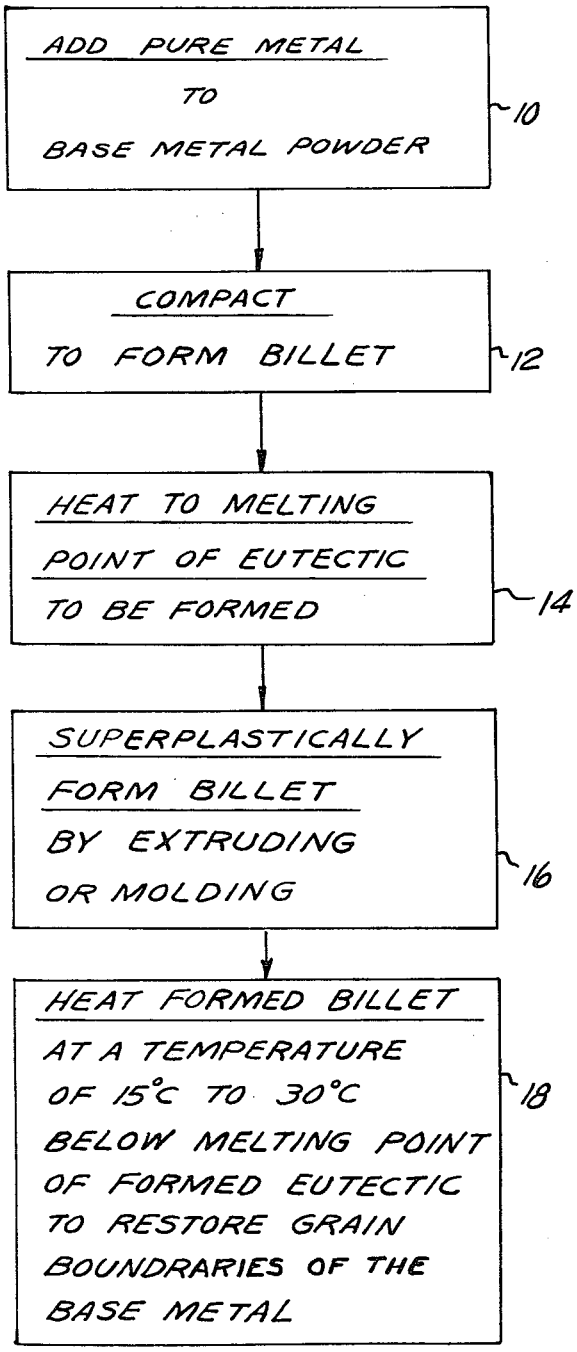
ADD PURE METAL
TO
BASE METAL POWDER
10
COMPACT
TO FORM BILLET
12
HEAT TO MELTING
POINT OF EUTECTIC
TO BE FORMED
14
SUPERPLASTICALLY
FORM BILLET
BY EXTRUDING
OR MOLDING
16
HEAT FORMED BILLET
AT A TEMPERATURE
OF 15°C TO 30°C
BELOW MELTING POINT
OF FORMED EUTECTIC
TO RESTORE GRAIN
BOUNDRARIES OF THE
BASE METAL
18

ALTERNATE METHOD FOR INDUCING SUPERPLASTIC PROPERTIES IN NONSUPERPLASTIC METAL AND ALLOY POWDERS

CROSS REFERENCE

The disclosed invention is related to my commonly assigned co-pending application Ser. No. 361,279 entitled "A Method for Inducing Superplastic Properties in Nonsuperplastic Metal and Alloy Powders" filed concurrently herewith.

BACKGROUND OF THE INVENTION

1. Field of the Invention

The invention is related to the field of powder metalurgy and in particular to a method for inducing superplastic properties in metal and alloy powders which have no superplastic properties.

2. Prior Art

Superplasticity is a property of certain alloys that allows them to be extensively deformed under appropriate conditions with very little stress. The prerequisite of superplastic alloys are defined by J. Wadsworth, T. Oyama and O. Sherby in their presentation "Superplasticity—Prerequisites and Phenomenology" at the *Inter-American Conference on Materials Technology,* Aug. 12–15, 1980, San Francisco, Calif., and by H. W. Hayden, R. C. Gibson and J. W. Broply in their article, "The Relationship Between Superplasticity and Formability", Metalurgical Society AIME, *Plenum Press,* 1971, pp. 475–497. Accordingly, for an alloy to exhibit superplasticity it should be of microduplex structure having a grain size of less than 10 micrometers, be either a eutectic or eutectoid composition, having a high strain rate sensitivity of flow stress and high angle grain boundaries.

A typical superplastic alloy is the nickel based alloy disclosed by Frecke et al in U.S. Pat. Nos. 3,702,791 and 3,775,101. Other superplastic alloys are described in the articles by J. Wadsworth et al and H. W. Hayden et al cited above.

Marya and Wyon, *Proceedings of the 4th International Conference on the Strength of Metals and Alloys,* Nancy France, Vol. 1, 1976, pp. 438–442 and Weill and Wyon, *Proceedings of the 5th International Conference on the Strength of Metals and Alloys,* Aachen, W. Germany, Vol. 1, 1979, pp. 387–392, have succeeded in making fine grained aluminum-gallium alloys superplastic at 50° C. by rubbing gallium on an aluminum surface and heat soaking the wetted aluminum at 50° C. for up to 50 hours. The invention is an alternative method for inducing superplastic properties in nonsuperplastic metal and alloy powders.

SUMMARY OF THE INVENTION

The invention is a method for inducing superplastic characteristics in nonsuperplastic metal and alloy powders. The method comprises adding to a nonsuperplastic material, metal or alloy in powder form, a pure metal capable of alloying with the nonsuperplastic material to form a eutectic having superplastic properties and melting temperature less than the nonsuperplastic material. The powder is then compacted under pressure and at a temperature either at or above room temperature to form a billet. The billet is heated to the temperature at which the eutectic forms then extruded or molded to the desired shape utilizing the superplastic properties of the formed eutetic. The formed article is subsequently heated to between 15° C. and 30° C. below the melting temperature of the formed eutectic to restore the grain boundaries of the nonsuperplastic alloy through the diffusion of the pure metal into the nonsuperplastic material.

The advantage of the disclosed method is that many nonsuperplastic metal or alloy powders can be made to appear as if they have a superplastic state. This apparent superplastic state permits these alloys to be formed into the desired shape using conventional extrusion and molding techniques at much lower temperatures and pressures. These and other advantages of the disclosed method will become apparent from a reading of the specification in conjunction with the drawings.

BRIEF DESCRIPTION OF THE DRAWINGS

FIG. 1 is a flow diagram of the invented process.

DETAILED DESCRIPTION OF THE INVENTION

Referring to the flow diagram of FIG. 1, a pure metal is added to a base metal powder made from a material not having superplastic properties as indicated in block 10. The material of the base metal powder may be either a pure metal or a metal alloy. The added pure metal should have the following characteristics:

(a) should be soluble and of high diffusivity in the base metal;

(b) should alloy with the base metal to form a eutectic having superplastic properties;

(c) should not significantly alter the properties of the base metal and/or cause embrittlement; and (d) should not be contaminated by the processing environment.

Correspondingly, the formed eutectic should have the following characteristics:

(a) should have a grain size of less than 10 micrometers;

(b) should have a melting point less than the melting point of the base metal;

(c) should have high angle grain boundaries; and (d) should have properties close to the properties of the added pure metal.

The pure metal may be added to the base metal powder as a thin coating applied to the external surfaces of the individual particles of the base metal powder or in powder form.

The individual particles of the base metal powder may be coated with the added pure metal by vacuum deposition, sputtering, ion beam milling, vapor deposition, electroplating or any other applicable method know in the art. The thickness of the coatings is selected such that the formed eutectic represents, preferably 6 to 8 percent or less of the total volume of each base metal particle. However, somewhat thicker or thinner coatings may be used.

When the pure metal is added in powder form, the quantity of added pure metal powder, again, is preferably selected so that the formed eutectic represents 6 or 8 percent by volume. The two powders are then thoroughly mixed using a shaker or ball mill to form a homogeneous mixture.

The base metal powder with the added pure metal is then compacted to form a billet as indicated by block 12. The compacting introduces strain energy into the system which acts as a driving force for the subsequent alloying and formation processes. The billet is then heat soaked at the melting point of the eutectic to be formed to allow the formation of the eutectic at the grain boundaries of the base metal particles as indicated by block 14. Soaking time may vary from 15 minutes up to a few hours depending upon the metals being alloyed and the billet size.

The billet is then formed to the desired shape utilizing the superplastic properties of the formed eutectic as indicated by block 16. The forming of the billet may be accomplished by conventional extrusion, molding, or other forming techniques known in the art at a temperature where the formed eutectic exhibits superplastic characteristics.

The forming of the billet may immediately follow the formation of the eutectic by lowering the temperature of the billet from the melting point of the eutectic to the temperature at which the eutectic has superplastic properties. Alternatively, after the formation of the eutectic the billet may be cooled to room temperature for storage and forming at a later time.

The formed billet is subsequently heat soaked at a temperature from 15° C. to 30° C. below the melting temperature of the formed alloy to further diffuse the pure metal into the base metal as indicated by block 18. By this process, most of the properties of the base metal grain boundaries are restored and the superplastic phase of the eutectic composition destroyed.

For nonsuperplastic ferrous metals and alloys aluminum may be added which will alloy with iron to form a eutectic having superplatic properties and a melting point of approximately 335° C. For aluminum and aluminum alloys the added pure metals may be lithium forming a eutectic having superplastic properties at approximately 160° C. or antimony forming a eutectic having superplastic properties at approximately 620° C. For copper and copper alloys the added pure metal may be tin forming a eutectic having superplastic properties at approximately 200° C.

Indium may also be used as the added metal for copper and coper alloys but no eutectic will form, however the resulting phase will have characteristics similar to those of superplastic materials. Additionally, aluminum may be used in combination with nickel and nickel alloys.

The advantages of this method are:

(1) Many nonsuperplastic metals and alloys can be made to appear as if they have superplastic properties.

(2) Nonsuperplastic metals and alloys can be formed at reduced temperatures and pressures thereby reducing tooling requirements.

(3) The base or nonsuperplastic material does not have to have ultra-fine grain sizes.

(4) Eliminates the problems encountered during superplastic forming of materials having thermodynamically unstable superplastic structures.

(5) Processing detail can be adjusted to obtain the high angle grain boundaries required for superplastic forming.

It is not intended that the invention be limited to specific examples disclosed and discussed herein. It is submitted that there are other pure metals which can be added to base metals and/or alloys to form a eutectic imparting superplastic properties to nonsuperplastic alloys within the scope of the invention as described herein and set forth in the appended claims.

What is claimed is:

1. A method for superplastically forming nonsuperplastic metallic materials, comprising the steps of:

adding a predetermined quantity of pure metal to a nonsuperplastic metallic material powder, said pure metal capable of alloying with said nonsuperplastic metallic material to form a eutectic having superplastic properties;

compacting said nonsuperplastic material powder with said added pure metal to form a billet;

heating said billet to the melting point of said eutectic to form said eutectic proximate the grain boundaries of the nonsuperplastic material powders;

superplastically forming said billet to the desired shape utilizing the superplastic properties of said formed eutectic; and heating said billet at a temperature between 15° C. and 30° C. below the melting point of said formed eutectic to dissolve said pure metal into said nonsuperplastic material and restore the grain boundaries of the nonsuperplastic material.

2. The method of claim 1 wherein said nonsuperplastic material includes both metals and alloys.

3. The method of claim 1 wherein said step of adding a pure metal comprises the step of applying a thin coat of said pure metal to the external surfaces of the particles of said nonsuperplastic material powder.

4. The method of claim 3 wherein said step of applying a thin coat includes the step of vacuum depositing said thin coat of pure metal.

5. The method of claim 3 wherein said step of applying a thin coat includes the step of vapor depositing said thin coat of pure metal.

6. The method of claim 3 wherein said step of applying a thin coat includes the step of electroplating said thin coat of pure metal.

7. The method of claim 1 wherein said step of adding comprises the steps of:

adding a predetermined quantity of pure metal, in powder form, to said nonsuperplastic material powder; and mixing said pure metal powder with said nonsuperplastic material powder to produce a homogenous mixture.

8. The method of claims 3 or 7 wherein said step of superplastically forming comprises the steps of:

heating said billet to a temperature at which said formed alloy has superplastic properties; and extruding said billet to said desired shape utilizing the superplastic properties of said formed alloy.

9. The method of claims 3 or 7 wherein said step of superplastically forming comprises the steps of:

heating said billet to a temperature at which said formed alloy has superplastic properties; and molding said billet to said desired shape utilizing the superplastic properties of said formed alloy.

10. A method for forming a billet from nonsuperplastic material powder having superplastic properties comprising the steps of:

coating the individual particles of the nonsuperplastic metallic material powder with a thin coat of a pure metal capable of alloying with the nonsuperplastic powder to form a eutectic having superplastic properties;

compacting the coated nonsuperplastic material powder to form a billet; and heating the billet to a predetermined temperature to alloy said thin coat of pure metal with said nonsuperplastic material to form a eutectic proximate the grain boundaries of said nonsuperplastic powders.

11. The method of claim 10 wherein said nonsuperplastic metallic material powder includes both metals and metal alloys.

12. The method of claim 11 wherein said step of coating includes the step of vacuum depositing said pure metal.

13. The method of claim 11 wherein said step of coating includes the step of vapor depositing said pure metal.

14. The method of claim 11 wherein said step of coating includes the step of electroplating said pure metal.

15. The method of claim 10 wherein said step of heating includes the step of heating said billet to the melting point of said eutectic.

16. A method for forming a billet from nonsuperplastic metallic material powder having superplastic properties comprising the steps of:

adding to a first predetermined quantity of the nonsuperplastic material powder a second predetermined quantity of a pure metal powder capable of alloying with said nonsuperplastic material to form a eutectic having superplastic properties;

mixing said nonsuperplastic material powder with said pure metal powder to form a homogeneous mixture;

compacting said homogeneous mixture to form a billet; and heating said billet to a predetermined temperature to alloy said pure metal powder with said nonsuperplastic material powders to form said eutectic proximate the grain boundaries of said nonsuperplastic powders.

17. The method of claim 16 wherein said nonsuperplastic metallic material powder includes both metals and alloys.

18. The method of claim 16 wherein said step of heating includes the step of heating said billet to the melting point of said eutectic.

* * * * *